United States Patent [19]

Hofmann et al.

[11] Patent Number: 4,797,018

[45] Date of Patent: Jan. 10, 1989

[54] RIBBON CASSETTE AND METHOD FOR OPERATING AN ELECTRONICALLY CONTROLLED TYPEWRITER

[75] Inventors: Norbert Hofmann, Nuremberg; Rudolf Spotka, Fuerth, both of Fed. Rep. of Germany

[73] Assignee: TA Triumph-Adler Aktiengesellschaft, Nuremberg, Fed. Rep. of Germany

[21] Appl. No.: 105,893

[22] Filed: Oct. 2, 1987

[30] Foreign Application Priority Data

May 27, 1987 [DE] Fed. Rep. of Germany ..... 3718013

[51] Int. Cl.[4] ..... B41J 41/00; B41J 35/30

[52] U.S. Cl. ..... 400/249; 400/208

[58] Field of Search ..... 400/249, 208, 174, 175

[56] References Cited

U.S. PATENT DOCUMENTS

| | | | |
|---|---|---|---|
| 3,731,781 | 5/1973 | Candill et al. | 400/249 |
| 4,386,862 | 6/1983 | Kittel et al. | 400/175 |
| 4,491,430 | 1/1985 | Kuelzer | 400/208 |
| 4,494,886 | 1/1985 | Kondo et al. | 400/208 |
| 4,577,200 | 3/1986 | Rix et al. | 400/175 |
| 4,636,097 | 1/1987 | Goubeanx | 400/249 |
| 4,655,624 | 4/1987 | Kondo et al. | 400/208 |

FOREIGN PATENT DOCUMENTS

| | | | |
|---|---|---|---|
| 64130 | 11/1982 | European Pat. Off. | 400/249 |
| 41577 | 2/1986 | Japan | 400/249 |
| 628003 | 10/1978 | U.S.S.R. | 400/249 |

*Primary Examiner*—William Pieprz

*Attorney, Agent, or Firm*—Browdy and Neimark

[57] ABSTRACT

A ribbon cassette with a memory makes it possible to provide a relatively exact determination of either the amount of ribbon remaining or the end of the ribbon with small mechanical outlay in an electronically controlled office machine or typewriter. A memory which contains external contacts and is capable of counting and storing values is provided from which base units can be subtracted by the control unit of the machine depending on the amount of ribbon advanced. The novel ribbon cassette makes it possible to dependably determine and display either the amount of ribbon remaining or the end of the ribbon.

8 Claims, 1 Drawing Sheet

RIBBON CASSETTE AND METHOD FOR OPERATING AN ELECTRONICALLY CONTROLLED TYPEWRITER

The invention relates to a ribbon cassette for electronically controlled typewriters or similar office machines and a method for operating an electronically controlled typewriter or similar office machine in connection with such a ribbon cassette, the electronically controlled office machine having an electronic control element connected with the memory in the ribbon cassette, with signaling means and with the drive for the ribbon.

BACKGROUND OF THE INVENTION

So-called unsupervised operation, among other modes, is possible with office machines of the type mentioned, which normally have an electronic control unit consisting of at least one microprocessor, a ROM memory containing the control program and a RAM memory receiving the variable data. For this reason it is necessary to generate a ribbon end signal before the start of a printing command or typing on the typewriter, in case the ribbon comes to its end, and to lock the printing mechanism and/or the keys.

In connection with the ribbon cassettes used in these machines it is already known from U.S. Pat. Nos. 4,494,886 and 4,655,624 to place a detector unit opposite a recess in the ribbon cassette housing for the purpose of detecting the end of the ribbon, through which the ribbon can be scanned, and thus a ribbon end signal is generated by the detector unit by means of a reflecting layer on the ribbon.

It is further known from U.S. Pat. No. 4,491,430 to provide a propeller driven by the ribbon for monitoring the ribbon, the vanes of which interrupt the signal path of a photoelectric barrier either directly or via drive members. When the signal change at the photo-electric barrier stops, for example when the end of the ribbon has been reached, the control unit monitoring the signal change generates a corresponding signal. Additionally, the core of the ribbon, which is movably supported in the ribbon cassette, blocks the propeller when reaching a predetermined amount of ribbon remaining and this can be used as described above.

Besides the absolutely necessary requirement of determining the end of the ribbon, it is also desirable in view of completing long print orders, perhaps in the unsupervised mode, to perform as accurate an estimate as possible of the amount of ribbon still available prior to the start of the print order. Up to now this was done, for example, by direct visual inspection, which required the opening of the housing. This in itself shows that this method is very cumbersome. However, the greatest disadvantage is the inherent inexactness of this technique.

To overcome these disadvantages, it is known from copending application Ser. No. 002,745 (owned by the present assignee) to estimate the amount of ribbon remaining by counting the ribbon advance steps made during the turning of the ribbon spool through a preset turning angle. For this purpose it is necessary to provide an incremental angle encoder on the ribbon cassette which can be read by means of a sensing device provided on the machine. The sensing signals thus produced are evaluated by an electronic control unit.

It is further known from U.S. copending patent application Ser. No. 061,311 (owned by the present assignee) to provide in the ribbon cassette a ribbon spool sensing element which is under the influence of a spring and which, for example, acts on a potentiometer so that the resistance that can be picked up constitutes a measurement of the amount of ribbon remaining.

SUMMARY OF THE INVENTION

While avoiding the disadvantages of conventional methods for the determination of the amount of ribbon remaining and of the end of the ribbon discussed above, it is an object of the invention to provide a ribbon cassette for office machines of the type indicated above which operates without a large mechanical outlay in the ribbon cassette as well as in the machine and makes possible dependable determination of the amount of ribbon remaining and of the end of the ribbon. Additionally it is an object of the invention to provide a method for the operation of electronically controlled typewriters or similar office machines in connection with the ribbon cassette of the invention.

The basis for attaining these objects is the assumption that a memory capable of counting, such as is known in a specialized form in connection with so-called value cards, for example from the article "Elektronische Schluesselkarten mit Mikroelektronik" [Electronic Code Cards with Microelectronics] in the magazine "n t z", vol. 35 (1982), issue 4, pp. 236 to 239, can be integrated with relative ease into a ribbon cassette and can be connected via corresponding contacts with the control unit of an electronically controlled typewriter in such a way that, depending on a specific length of ribbon used, "charge-off signals" can be transferred to the memory capable of counting; and thus the status of the memory, which equals the maximum status in unused ribbon cartridges, can be made operational in relation to the length of ribbon used up. This status of the memory corresponding to the actual amount of ribbon used can be read by means of the electronic control unit and can be displayed accoustically and/or optically via corresponding signal means.

The advantage of such a ribbon cassette primarily consists of keeping down the mechanical outlay in the ribbon cassette as well as in the machine. By means of the method of operation, a dependably accurate indication of the remaining amount of ribbon can be made or a ribbon end signal can be dependably triggered.

An exemplary embodiment of the ribbon cassette in accordance with the present invention as well as an example of the method for operating a typewriter or similar office machine in connection with a ribbon cassette according to the invention are described in detail below with reference to the drawings.

DETAILED DESCRIPTION OF THE PREFERRED EMBODIMENT

Figure 1:
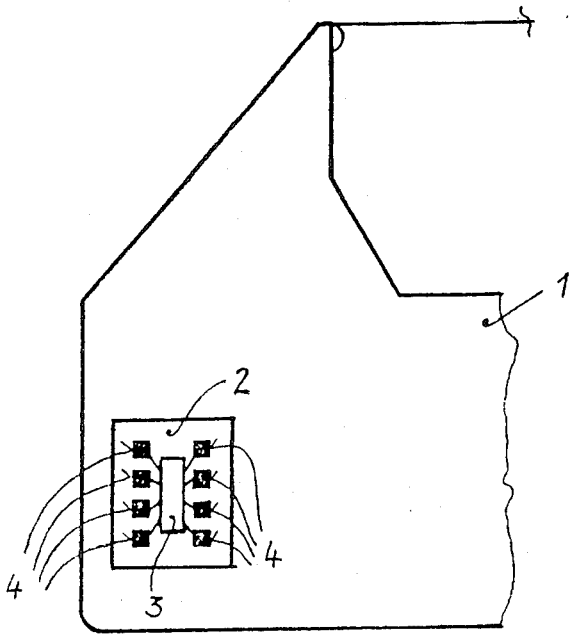
FIG. 1 is a partial view of a ribbon cassette with a memory capable of counting.

FIG. 1 is a partial view of a ribbon cassette 1 onto which has been glued or otherwise connected a carrier 2. The carrier 2 contains a memory 3 which is capable of counting, and which is connected via respective lines with contacts 4 disposed on the upper surface of the carrier 2. The contacts 4 are disposed in such a way that they make working contact with opposite contacts on a machine (not shown), such as a printer or typewriter, when the ribbon cassette is inserted in such a correspondingly designed machine, so that via these and correspondingly provided lines (not shown) the connection with the control unit of the machine is made.

A memory capable of counting as mentioned above is a memory the status of which can be changed by a base unit or multiples thereof. In the simplest case this means, for example, a number of "safeties" which can be successively destroyed by an electrical pulse, so that the number of destroyed "safeties" corresponds to the "charged off" amount of base units, while the amount of whole "safeties" corresponds to the amount of base units still present.

However, such a memory capable of counting can also be a memory which contains, as known from the article mentioned above, a semiconductor memory and further logic circuits for the management of the semiconductor memory. In such a memory capable of counting, the maximum status can also be made operational by "charging off" of base units.

Furthermore, memories capable of counting by operating magnetically or optically are also possible. In such a case the contacts 4, which are in the form of electrical contacts in FIG. 1, would be replaced by magnetic or optical contact means.

Figure 2:
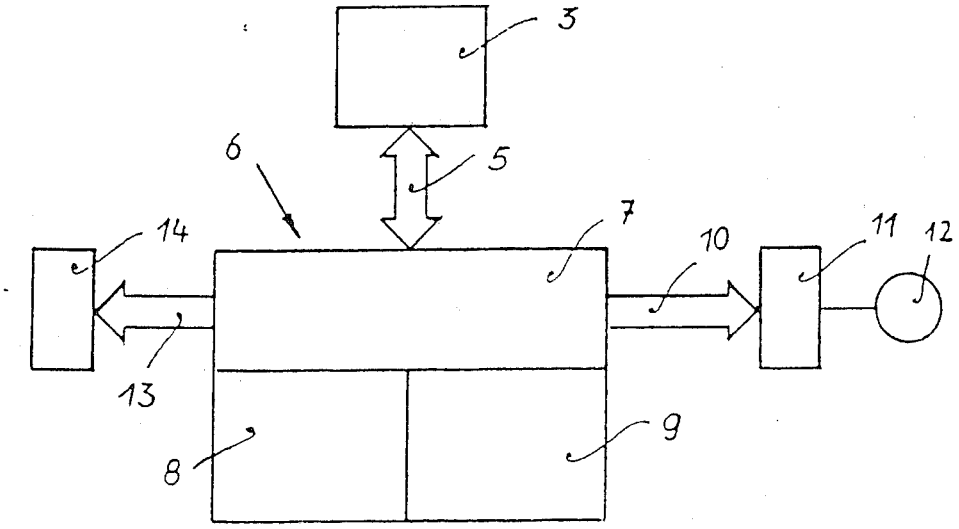
FIG. 2 is a block wiring diagram.

The way in which the capable-of-counting memory 3 of FIG. 1 cooperates with the control unit disposed in the machine is shown in FIG. 2. The memory 3, here only schematically shown, is connected via lines 5 with the control unit 6 disposed in the machine, which has a microprocessor 7 and a ROM memory 8 containing the control program as well as a RAM memory 9 receiving the variable data. The control unit 6 itself is connected via lines 10 and a driver circuit 11 to a step motor 12 serving as drive motor for the ribbon advance mechanism (not shown) and is connected via lines 13 to a display device 14.

To show the operation of the device described above, it is first assumed that the maximum status of the capable-of-counting memory 3 is the same for all types of ribbons. It is further assumed that a ribbon has been inserted into the machine and that the machine has been switched on.

When the machine is switched on or every time the lid which permits access to the ribbon cassette is opened or closed—the opening and closing being recognized in a known manner by means of a lid switch—and after the control unit 6 has been brought into a defined initial status (reset), a switching-on routine is initialized. Among other things, those setting devices giving information in relation to the type of ribbon contained in the ribbon cassette as well as to the selected spacing are polled and stored in the RAM memory when the switching-on routine is initialized. These setting devices can be set manually or obtained by means of corresponding control routines, known per se, which are part of the switching-on routine, for example automatic ribbon type detection, automatic print wheel detection, etc.

To determine and display the amount of ribbon still remaining in the ribbon cassette, the status of the memory 3 is polled by the control unit 6 via lines 5, and then is brought into displayable form by the control unit 6 and displayed on the display device 14 via lines 13. Display on the display device 14 can take different forms and is further explained below. Additionally, the control unit 6 compares the polled status of the memory 3 which is capable of counting, for instance, down to zero and, if it is equal to zero, triggers an additional warning signal and/or locks the print mechanism and/or the keys.

In the following it is assumed that the status of the memory 3, polled during the switching-on routine, is not equal to zero. Also in the course of the switching-on routine, a counter, which is a memory cell in the RAM memory 9, is set to a value which is obtained by the control unit 6 by reforming the stored setting devices (type of ribbon and spacing) into an address and polling the value stored at this address. The mode of operation of the counter is also described below.

At the end of the switching-on routine it is now possible, provided that the status of the memory 3 which has been polled during the switching-on routine is not equal to zero, to start a printing operation using printers or to start typing with a typewriter. During the printing or the typing the status of the memory 3 should be made operational. This is described below by means of an example.

The counter mentioned above is used for emitting a signal for a predetermined length of ribbon used. The reason for the necessity for this counter lies, as mentioned above, in the fact that for reasons of simplicity, the same memory 3 (capable of counting) is to be used in connection with all types of ribbons. Furthermore, because a small capacity of memory 3 is used for reasons of economy, it is not possible to count a base unit for each forward step of the ribbon. Thus the counter has a divider function, the divider ratio depending on the type of ribbon used and on the spacing used. The value stored in the counter (RAM memory) during the switching-on routine is dependent on the ribbon used and on the typing mode. In order to generate a signal after a certain length of ribbon, the control unit 6 decreases the counter following each ribbon advance step—which it triggered by control of the step motor 12 via the lines 10 and the driver circuit 11—and then polls the counter status for agreement with zero. As soon as agreement with zero is reached, the control unit 6 sends a signal to the memory 3 via the lines 5, the status of which is then reduced by a base unit. Then the control unit 6 again polls the status of the memory 3 and displays it on the display 14 via the lines 13, as explained in connection with the switching-on routine. Additionally, the control unit 6 compares the status of the memory 3 and triggers an additional warning signal or locks the printing mechanism and/or the keys when agreement with zero is reached. If not equal to zero, the control unit 6 sets the counter to the initial value as described in connection with the switching-on routine.

As mentioned above, numerous different possibilities exist to display the amount of ribbon still remaining on the display 14. The display can be done either in discrete steps (ribbon cassette $\frac{3}{4}$, $\frac{1}{2}$, $\frac{1}{4}$ or completely empty) or semicontinously (e.g. as a bar graph) or in the form of alphanumerical information. Furthermore a combination with an accoustical signal emission is possible. This can be in the form of a sound signal of differing length or frequency or perhaps a report in synthetic language. The methods for signaling mentioned above are known per se, so that further descriptions in this respect are not necessary.

Because of the determination initially made that the maximum status of the memory 3 is the same for all types of ribbons, the status of the memory 3 and thus of the amount of ribbon in the ribbon cassette 1 is displayed on the display device 14 by means of the method described above. Of course, alternatively there is the possibility of determining and displaying the absolute value, for example in the form of the number of characters still printable, by recalculating with a factor determined by the type of ribbon and spacing selected. This is especially appropriate shortly before the end of the ribbon is reached.

As already mentioned above, the control unit 6 does not generate a "charge-off signal" for each ribbon advance step, but only after a number preset by the counter. This causes inaccuracy, since the counter status is in general between the minimum and maximum status when the machine is switched off and is reset in accordance with the method described above to a preset value (maximum value) when it is switched on again. Choosing a smaller number of ribbon advance steps corresponds to a smaller inaccuracy. Because of this inaccuracy, the "charge-off" of the ribbon already used does not take place. To account for this circumstance a ribbon reserve can be provided which compensates for the inaccuracy.

To decrease the inaccuracy mentioned above even more, there is the possibility of providing the counter in the form of a non-volatile memory cell and to dispose it on the ribbon cassette 1 together with the memory 3 capable of counting, so that only an inaccuracy caused by the possibly different spacing exists, which is negligible.

Finally it should be mentioned that in the case of proportional spacing, where there is no basis of constant spacing and thus no constant ribbon advance step, an empirically determined value can be assumed as the spacing step and used for the fixing of the counter value, so that when normal texts are printed the inaccuracies caused by this are so small that they can be disregarded.

It is to be understood that the specific embodiments described above are given as examples only and that many other embodiments and further improvements are possible within the scope of the invention.

What is claimed is:

1. A ribbon cassette for an electronically controlled typewriter said ribbon cassette comprising an electronic memory equipped with external electronic contacts, said memory being capable of storing a changeable value corresponding to a respective amount of ribbon left for use in the cassette, and which stored value can be changed as a result of electrical signals received via said contacts.

2. The cassette of claim 1, wherein said memory is a semiconductor memory.

3. The cassette of claim 1, comprising a carrier having said memory glued thereon, said carrier being glued onto said cassette.

4. The cassette of claim 1, wherein said memory is glued onto said cassette.

5. A method for the operation of an electronically controlled typewriter in connection with a ribbon cassette, said cassette having an electronic memory equipped with electronic contacts external to said cassette, said memory being capable of storing at least one value and of changing said stored value in accordance with an amount of the ribbon in said cassette still available for use, the electronically controlled typewriter having an electronic control unit connected with said memory on the ribbon cassette, said electronic control unit including signal means for generating signals corresponding to usage of the ribbon and a drive for the ribbon advance mechanism, said method comprising:

producing signals from said signal means of said electronic control unit corresponding to a respective amount of ribbon advanced by said ribbon advance mechanism, and feeding said signals to said memory in the ribbon cassette, such that the value then stored in said memory, which corresponds to the amount of ribbon still available, is reduced by an amount which corresponds to said respective amount of ribbon which has been advanced;

cyclically polling said memory in said ribbon cassette with said contacts thereof to determine the value then stored therein; and providing information corresponding to the polled status of said memory according to the determined stored value.

6. The method of claim 5, said providing of said information comprising displaying said information in a display.

7. The method of claim 5, said providing of said information comprising providing a corresponding audible signal at least when said information indicates insufficient remaining ribbon in said cassette.

8. The method of claim 5, said providing of said information comprising preventing a subsequent printing operation when said information indicates insufficient remaining ribbon in said cassette.

* * * * *